US006662690B1

(12) United States Patent
Ploeger

(10) Patent No.: US 6,662,690 B1
(45) Date of Patent: Dec. 16, 2003

(54) PLIERS FOR CLAMPING A HOSE OR TUBE

(75) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 10/176,331

(22) Filed: Jun. 20, 2002

(51) Int. Cl.[7] ..... B25B 7/12
(52) U.S. Cl. ..... 81/318; 81/349; 81/383
(58) Field of Search ..... 81/318, 324, 329, 81/381, 339, 342, 308, 346–352, 362–363, 383, 383.5, 376

(56) References Cited

U.S. PATENT DOCUMENTS

| | | | | |
|---|---|---|---|---|
| 682,701 | A | 9/1901 | Howland | |
| 1,026,270 | A | 5/1912 | Leonard | |
| 1,450,875 | A | 4/1923 | Teselsky | |
| 1,717,726 | A | 6/1929 | McGill | |
| 2,096,016 | A | * 10/1937 | Weishampel | 81/361 |
| 2,370,308 | A | 2/1945 | Hanson | |
| 2,574,909 | A | 11/1951 | Burrows | |
| 2,787,925 | A | 4/1957 | Buchanan et al. | |
| 3,091,841 | A | * 6/1963 | Wurzel | 81/349 |
| 3,126,775 | A | 3/1964 | Ramge | |
| 3,257,878 | A | 6/1966 | Andersen | |
| 5,005,450 | A | 4/1991 | Ford | |

OTHER PUBLICATIONS

"Rotor Clamp", Automotive Egineering, Feb., 1993, p. 132.
"Hose Clamps", Automotive Engineering, Apr., 1993, p. 52.
"Hose Clamp Pliers", Hazet Specialty Tools Catalog, Item #798–10, (Speicific date of publication unknow—at least prior to Jun. 20, 2002).
"Flat Band Hose Clamp Pliers", K–D Tools Catalog, pp. 60–61, Item #D.3252, (Specific date of publication unknown—at least prior to Jun. 20, 2002).
"Adjustable Hose Clamp Pliers", OTC Catalog, p. 3, Item #7877, (Specific date of publication unknown—at least prior to Jun. 20, 2002).
"Rubber Hose Pinch Off Pliers", OTC Catalog, p. 89, Item #7655, (Specific date of publication unknown—at least prior to Jun. 20, 2002).

* cited by examiner

*Primary Examiner*—D. S. Meislin
(74) *Attorney, Agent, or Firm*—Banner & Witcoff, Ltd.

(57) ABSTRACT

Clamping pliers includes a first handle with a first jaw, a second handle, a separate second jaw all of which are pivotally connected to a pivot to affect pivoting about the same pivot point. A connecting link connects the second jaw with camways defined in the first and second handles. A pin extending from the link engages the camways and upon closure of the handles provides a clamping action.

7 Claims, 3 Drawing Sheets

PLIERS FOR CLAMPING A HOSE OR TUBE

BACKGROUND OF INVENTION

In a principal aspect the present invention relates to a pliers which is especially useful for clamping hoses and other objects and for maintaining a tightly closed or clamped position on the object such as a hose.

Vehicle repair operations and other mechanical repair situations often require that a hose or some other object be gripped and clamped so as to maintain the hose or the object in a desired compressed condition. This result is also often desired in medical applications wherein a clamping action is desired to close a vessel for example. However, the clamping action must be limited in terms of its pressure and degree of closure so that when a clamped condition is reached, the vessel will not be ruptured or damaged. The same desire is applicable to vehicle repair and other mechanical repair operations involving hoses or other items that must be clamped or joined together from time to time.

Various prior art proposals and solutions have been tendered to accomplish such objectives. Adjustable clamps comprise one such solution. So called "channel locking" pliers provide another solution. Various types of tools have been proposed including tools of the type of disclosed in U.S. Pat. No. 5,005,450 for a self locking tool and various patents cited therein. Other types of clamping plier devices are depicted in the following U.S. Pat. No. 682,701; U.S. Pat. No. 2,574,909; U.S. Pat. No. 1,717,726; U.S. Pat. No. 1,450,875; U.S. Pat. No. 1,026,270; U.S. Pat. No. 2,370,308; U.S. Pat. No. 3,257,878; U.S. Pat. No. 2,787,925; and U.S. Pat. No. 3,126,775. Each of these solutions has benefits and disadvantages. There has remained, however, a desire to provide a clamping mechanism or tool for hoses and other objects which provides a positive closure of the clamping jaws with limited clamping pressure or travel of the jaws toward one another yet which provides a retentive force that will appropriately close a hose and hold with the desired degree or amount of pressure. These and other objectives inspired the development of the present invention.

SUMMARY OF THE INVENTION

Briefly, the present invention comprises a pliers construction which includes four pivotally connected members. Thus included in the pliers construction is a first handle member with a first jaw, a second handle member which is pivotally connected to a separate, second jaw and the first handle member and a linkage bar pivotally connected to the second jaw at one end and engaging its opposite end by means of a cam pin with a pair of opposed cam slots defined in the first and second handle members. The interaction of the cam pin carried by the link and the cam slots associated with the handles provides a locking action when the handles are moved together. With the particular construction of the invention it is possible to provide a clamping action more easily because the handles may be more closely spaced and the extent of travel of the handles reduced in order to move the jaws between the open and clamped positions. Thus, the clamping action by the pliers can be affected more easily by a mechanic or other user of the pliers construction. The jaws may include optional pivotal plates which typically and preferably comprise flat planer plates that apply opposite and equally opposed forces of the opposite sides of a hose or other object when the jaws are closed.

Thus it is an object of the invention to provide an improved clamping pliers.

It is a further object of the invention to provide a clamping pliers comprised of four separate elements including a first lever arm or handle which includes an integrated jaw, a second, separate lever arm or handle, a separate second jaw, and a connecting link. The two handles and jaws are pivotally connected and the link interconnects the second jaw with overlapping cam slots in the handles.

It is yet another object of the invention to provide a pliers construction which enables efficient use of amount of travel associated with the handles of the pliers in order to effect a clamping action.

Yet a further object of the invention is to provide a four component clamping pliers which includes a single pivot for two handles and the jaws of the pliers, and a link which controls the interaction of the movement of the handles and jaws.

Yet another object of the invention is to provide a clamping pliers which is easily manufactured, easily utilized by mechanics, rugged and economical.

These and other objects, advantages, and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
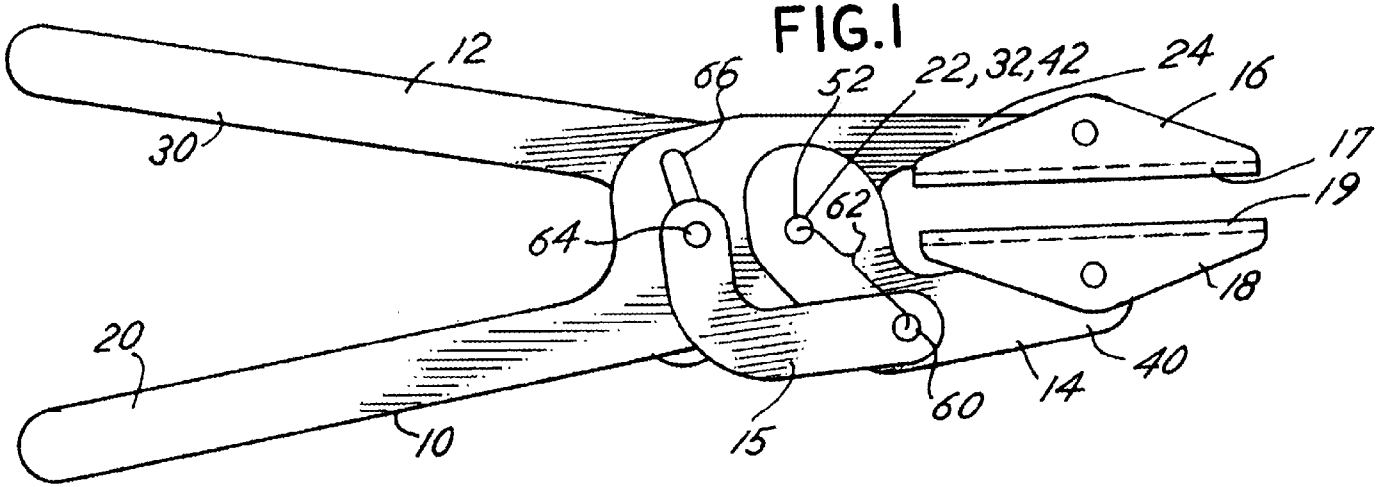
FIG. 1 is a plan view of the pliers of the invention wherein the handles have been moved to the closed position.
Figure 2:
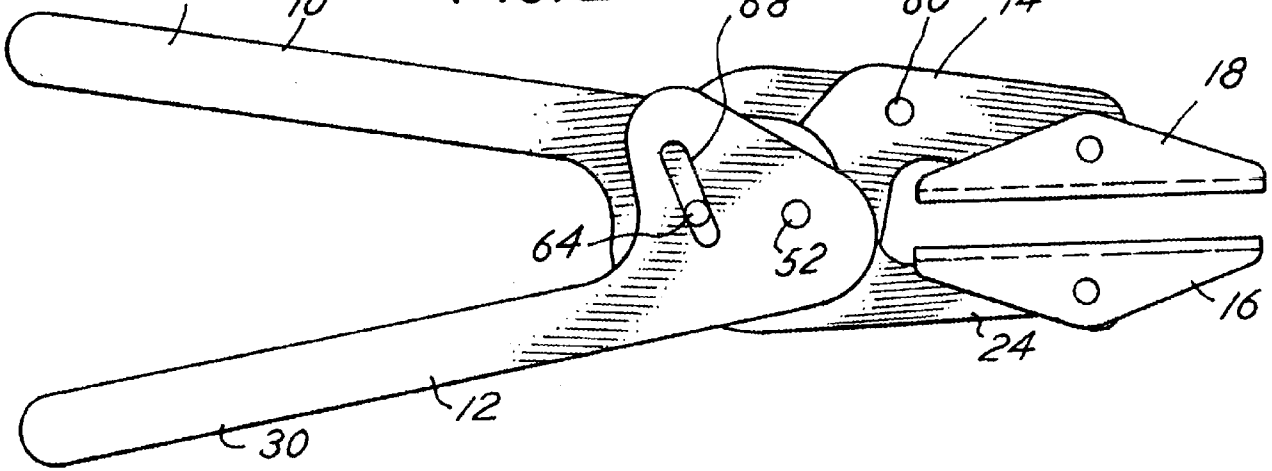
FIG. 2 is a plan view of the pliers of FIG. 1 as viewed from the opposite side thereof.
Figure 3:
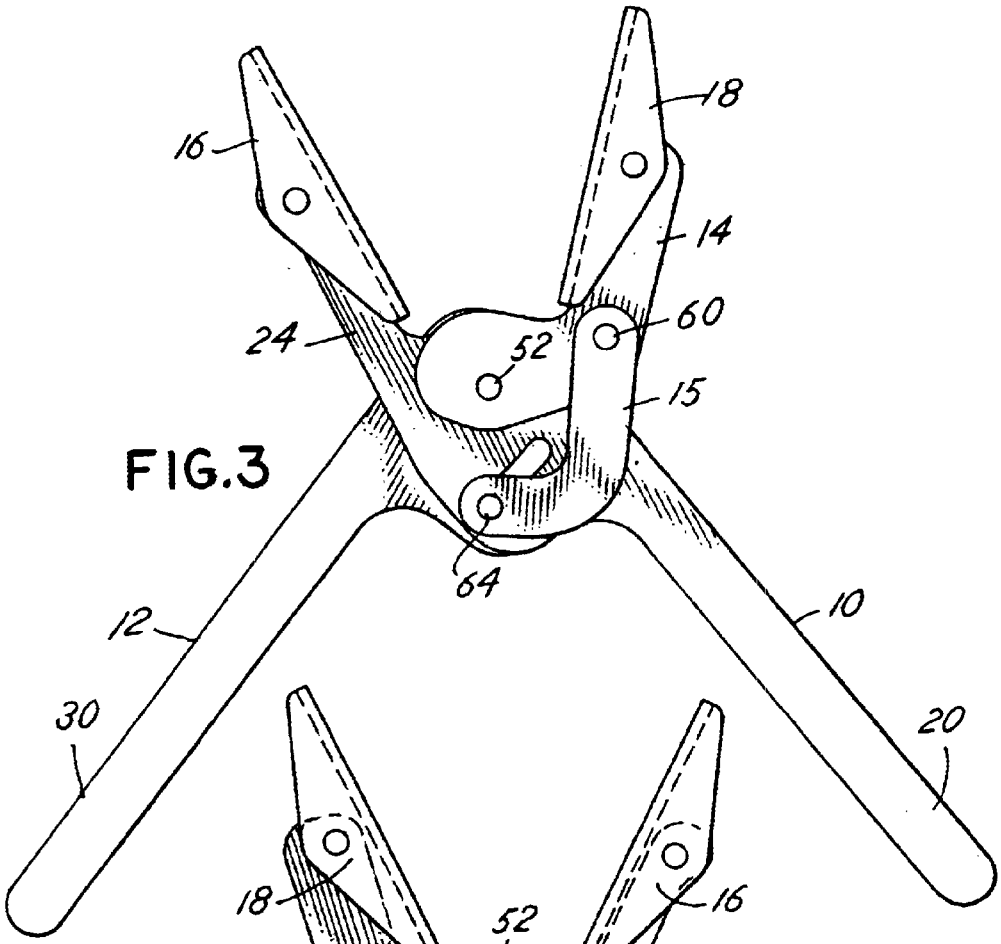
FIG. 3 is a plan view of the pliers of FIG. 1 wherein the handles have been moved to the open position.
Figure 4:
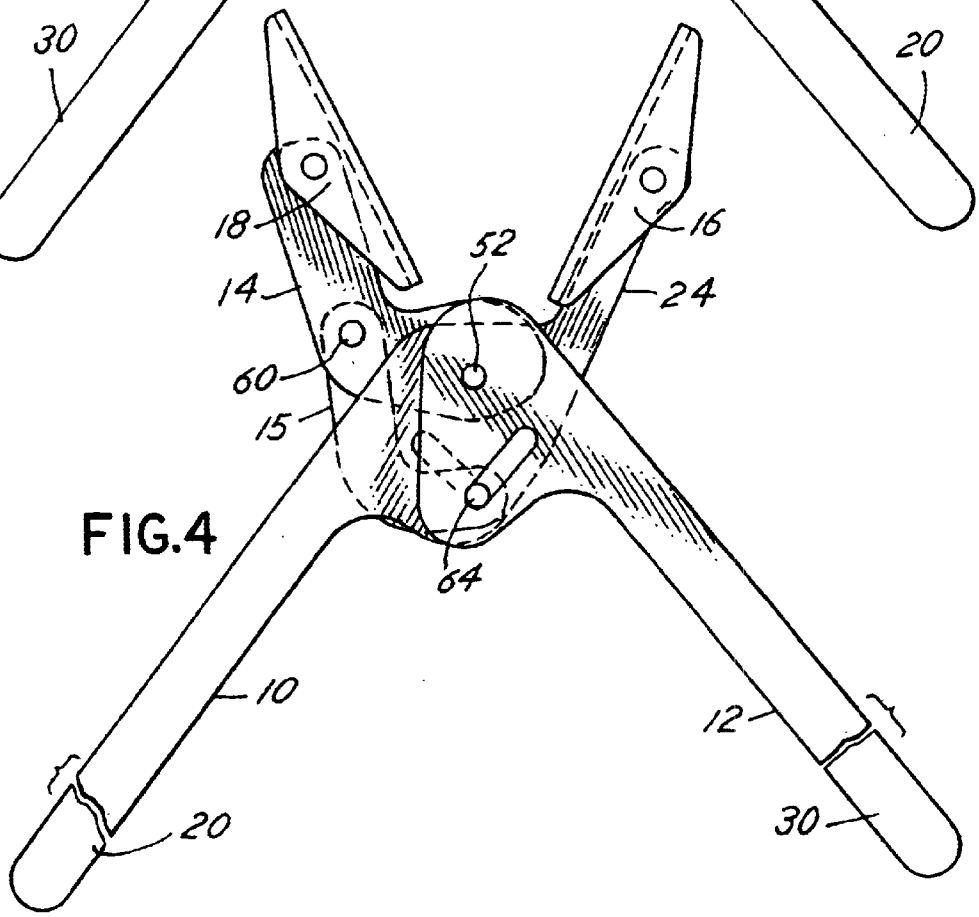
FIG. 4 is a plan view of the pliers of FIG. 3 as viewed from the opposite side thereof.

Referring to the figures, the clamping pliers includes a first handle 10, a second handle 12, a second jaw 14, and a link 15 as separate and individual parts. Optional jaw plates 16 and 18 are provided for attachment to the separate jaws of the pliers.

Figure 6:
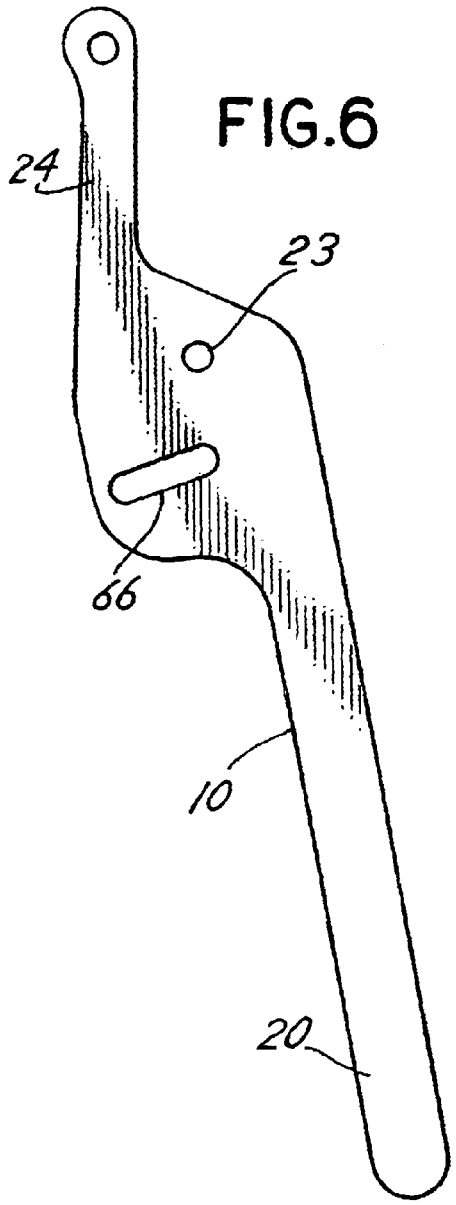
FIG. 6 is a plan view of the second handle of the pliers of the invention.
Figure 5:
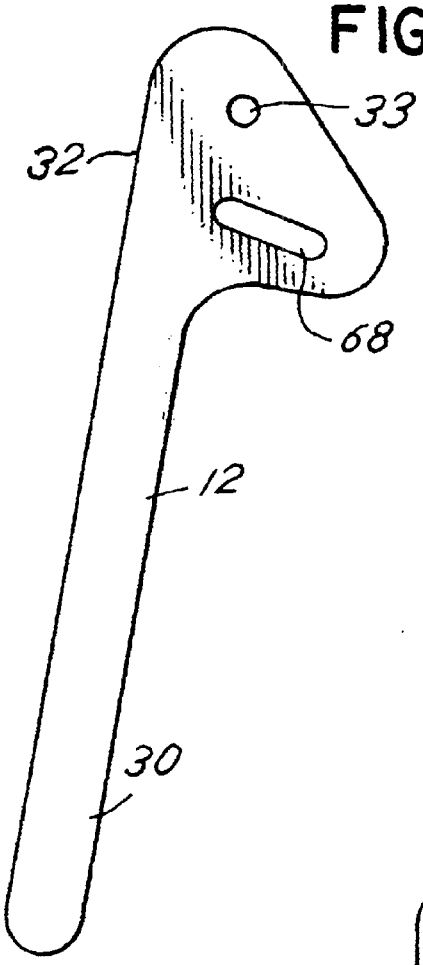
FIG. 5 is a plan view of the first handle associated with the pliers of FIG. 1.
Figure 7:
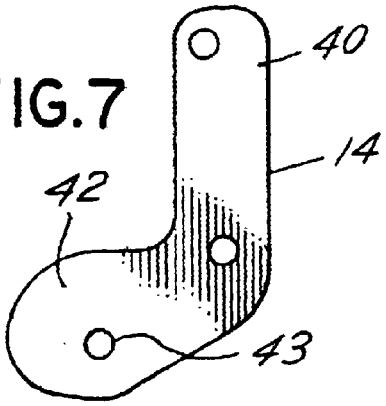
FIG. 7 is a plan view of the second jaw of the pliers of the invention.
Figure 8:
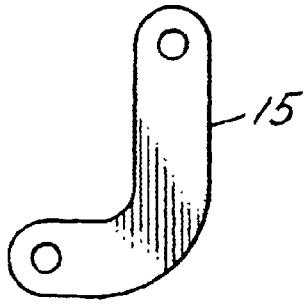
FIG. 8 is a plan view of the link connecting the second jaw with the cam ways associated with the handles.

The first handle member or lever arm 10 includes handle section 20, a pivot or center portion 22 including a pivot opening 23 and a first jaw 24 (see FIG. 6). The second handle or lever arm 12 includes a handle section 30 and a pivot section or center portion 32 with a pivot opening 33. The second lever arm 12 does not include an integral jaw. Rather there is provided a second jaw 14 with an active jaw end 40 and a pivot section 42 and pivot opening 43. The pivot openings 23, 33, 43 of the lever arm 10, lever arm 12 and second jaw 14, respectively are all commonly connected by a single pivot pin 52 for pivoting about a common axis.

The first lever arm 10 includes a forward jaw section 24 to which is optionally attached the jaw plate 16. The jaw plate 16 comprises a parallel planar plate member 17 which is opposed to a parallel planar plate member 19 associated with jaw plate 18 so that when the jaw plates 16 and 18 are moved together they will uniformly compress a hose, for example.

The second jaw 14 is connected by link 15 to both the first lever arm 10 and second lever arm 12. More particularly the link 15 includes a pivot attachment 60 to second jaw 14 which is positioned at a fixed radius 62 from the pivot pin 52.

The link 15 further includes a pivot pin 64 which defines or comprises a cam member that engages with a slot or camway 66 in the lever arm 10 and camway or slot 68 in the lever arm 12. The camway 66 and 68 are spaced from the pivot pin 52 by a radial distance which is variable along the length of each camway 66, 68. The camway 66 and 68 are overlapping one with the other and, in the embodiment shown, are straight line slots with an increasing radial distance from the center axis or pivot 52 as the handles 10, 12 are spread in equal and opposite amounts. When the lever arms 10 and 12 are in the closed position, then, the radial distance of the pin 64 in the respective camways 66 and 68 to pivot 52 is a minimum. and this alignment and engagement by pin 64 with the camways 66, 68 causes the pliers to be in a substantially locked or rigid position. Manual actuation is required to release the handles 20 and 30 and thus release the clamping action.

Various other shapes and directions of camways may be utilized in the construction of the invention. For example, arcuate camways may be provided. The length of each camway 66, 68 may be distinctive. Detents (not shown) may be provided in the camways. The camways or cam pathways 66, 68 intersect at some angle, which may be varied to provide different jaw closure rates. Importantly the camways 66, 68 must overlap inasmuch as a single cam pivot pin 64 simultaneously engages both camways 66, 68. The clamping action is, however, attained by the interaction of the cam pivot pin 64 and the camways 66, 68 and the pressure that results when attaching the pliers on a hose or other object which is to be gripped.

The construction may be altered or amended without departing from the spirit of the scope of the invention. The invention is therefore to be limited only by the following claims and equivalents thereof.

What is claimed is:

1. A pliers for clamping a hose comprising in combination:

a first lever arm including a first jaw at one end, a handle at the opposite end and an intermediate pivot;

a second lever arm including a pivot at one end connected with the intermediate pivot of the first lever arm, and including a handle at the opposite end opposed to and aligned with the first lever arm handle;

a jaw member including a pivot connected to the pivots of the first and second lever arms for pivoting about a common pivot axis and further including a second jaw in opposed relation to the first jaw; and a connecting link pivotally attached at one end to the jaw member and including a cam member engaged at the opposite end of the link simultaneously to a first cam pathway in the first lever arm and a second cam pathway in the second lever arm, said first and second cam pathways each being radially spaced from the common pivot axis whereby closure of the handles by movement of the handles toward each other about the common pivot axis effects movement of the jaws toward each other.

2. The pliers of claim 1 wherein the cam pathways comprise first and second straight slots intersecting at an angle.

3. The pliers of claim 1 wherein the cam pathways comprise slots and the cam member comprises a pin for engagement with the slots.

4. The pliers of claim 1 wherein the cam link is engaged with the cam pathways by means of a cam member comprising a pin.

5. The pliers of claim 1 wherein the cam pathways each include a first end and a second end, and wherein alignment of the first end of each cam pathway by engaging the link comprises a means for holding the pliers in a closed position.

6. The pliers of claim 1 wherein the cam pathways comprise generally straight intersecting slots and the cam link is connected to the slots by a cam member comprising a pivot pin.

7. A pliers for clamping a hose comprising, in combination:

a first arm with an intermediate first pivot, a first jaw at one end, a handle at the opposite end and a first cam slot spaced from the pivot, a second arm with a second pivot at one end, a handle at the opposite end, and a second cam slot intermediate the handle and pivot, said second cam slot overlying the first cam slot, said first and second pivots being congruent;

a jaw member including a second jaw and a jaw member pivot congruent with the first and second arm pivots; and a link pivotally connected to the jaw member by a jaw member pivot connection and to the first and second cam slots by a cam member engaging simultaneously the first and second slots, whereby the jaws are moved toward each other in response to movement of the handles toward each other.

* * * * *